United States Patent [19]

Hihi

[11] Patent Number: 4,684,919

[45] Date of Patent: Aug. 4, 1987

[54] LIGHT-SOURCE MULTIPLICATION DEVICE

[76] Inventor: Bachir Hihi, 1888 Peeler Rd., Dunwoody, Ga. 30338

[21] Appl. No.: 785,848

[22] Filed: Oct. 9, 1985

[51] Int. Cl.[4] ..... F21V 5/00; F21V 5/02

[52] U.S. Cl. ..... 340/84; 340/74; 350/106; 350/109; 362/244; 362/300; 362/307; 362/317; 362/326; 362/347

[58] Field of Search ..... 340/84, 74; 350/106, 350/109, 436, 286; 362/300, 244, 307, 245, 308, 309, 311, 332, 317, 326, 327, 328, 333, 334, 335, 336, 337, 338

[56] References Cited

U.S. PATENT DOCUMENTS

| | | | |
|---|---|---|---|
| 1,090,278 | 3/1914 | Coates | 350/286 |
| 1,568,899 | 1/1926 | Mercer et al. | 350/109 |
| 2,099,671 | 11/1937 | Bairey | 350/109 |
| 2,444,356 | 6/1948 | Luce | 350/106 |
| 2,752,478 | 6/1956 | Clark | 362/337 |

*Primary Examiner*—Charles A. Ruehl
*Assistant Examiner*—T. Rittmaster

[57] ABSTRACT

A light-source multiplication device useful in a warning light device, a traffic signal light device, a light display or a lighted sign includes light-emissive diodes as light sources with a multi-prism having facets having apices on an imaginary spherical surface for providing multiple images of the light-emissive diodes, some of which can be viewed over a wide field of vision, thereby minimizing power and maintenance requirements of the device.

18 Claims, 29 Drawing Figures

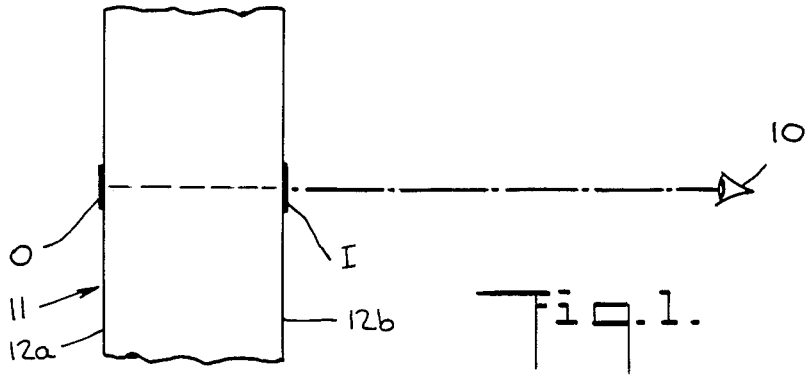
Fig. 1.
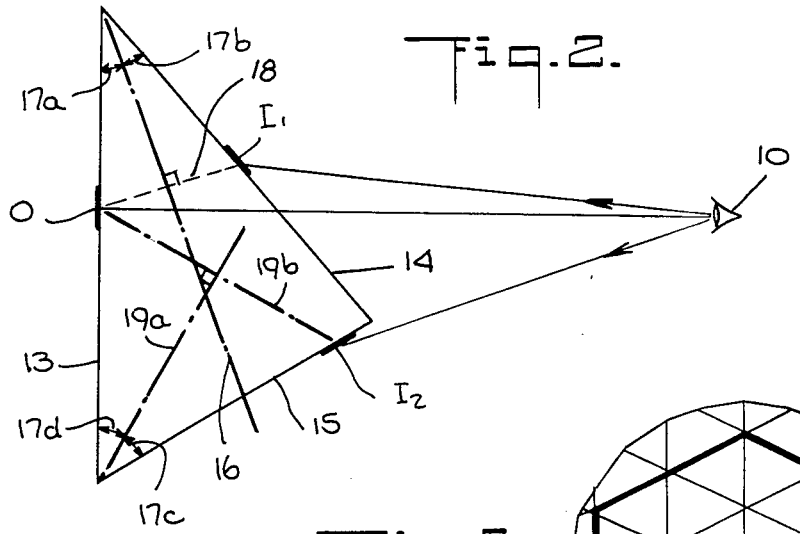
Fig. 2.
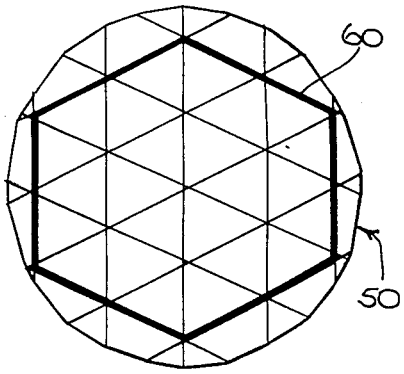
Fig. 6.
Fig. 5.
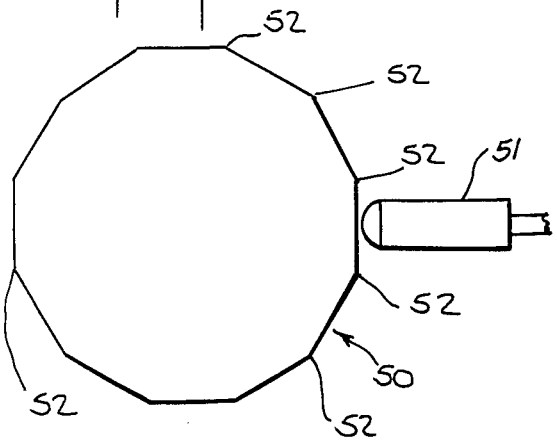
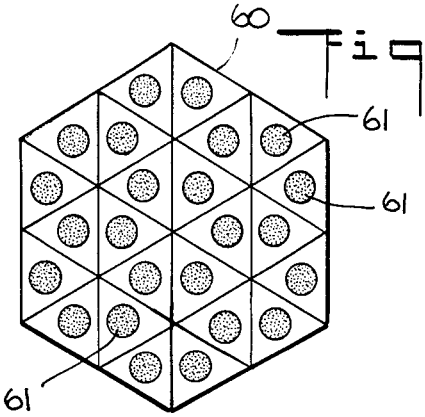
Fig. 7.

LIGHT-SOURCE MULTIPLICATION DEVICE

This invention relates to light-source multiplication devices and, more particularly, to such devices suitable for use as traffic signal devices, warning signal devices, lighted signs and the like. Light-emissive diodes are particularly suitable as light sources in such devices.

U.S. Pat. No. 4,271,408 relates to a colored light-emitting display utilizing a plurality of light-emitting diodes and a reflector member for use as a traffic signal device with power dissipation and maintenance care being reduced by the light emitting diodes which have low power consumption and a long service life. Such a display, however, requires many more light-emitting diodes than a traffic signal device utilizing a light-source multiplication device in accordance with my invention.

It is an object of the invention, therefore, to provide a new and improved light-source multiplication device suitable for use in a light display which avoids one or more of the above-mentioned disadvantages of prior such displays.

It is another object of my invention to provide a new and improved light-source multiplication device suitable for use as a traffic signal device in which the number of light sources and the power and maintenance requirements thereof are minimized.

It is another object of the invention to provide a new and improved light-source multiplication device for use in a warning signal device in which the number of light sources and the power and maintenance requirements thereof are minimized.

In accordance with the invention, a light-source multiplication device comprises a light-transmissive portion having faces having apices on an imaginary spherical surface. The device includes at least one light source disposed in proximity to at least one of the faces for transmitting light through the light-transmissive portion to form a visible image at a plurality of the faces.

For a better understanding of the present invention, together with other and further objects thereof, reference is made to the following description, taken in connection with the accompanying drawings, and its scope will be pointed out in the appended claims.

Referring now to the drawings:

FIGS. 1 and 2 are schematic diagrams to aid in explaining the operation of the device;

FIGS. 5, 6 and 7 are schematic diagrams representing an embodiment of my device.

Figure 4:
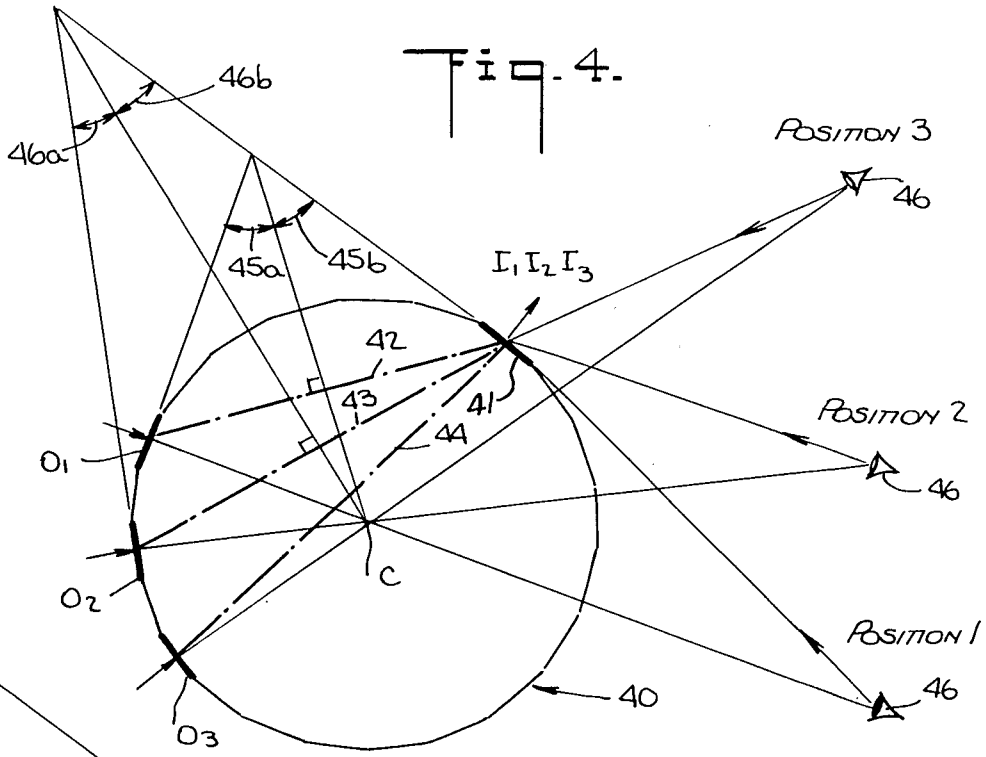
FIGS. 3 and 4 are schematic diagrams representing embodiments of my invention suitable for use in a traffic signal or other light display device.

Referring now more particularly to FIG. 1 of the drawings, an observer represented by an eye 10 directly in line with an object O, for example, a light-emissive diode disposed against a light-refractive member 11, such as glass or a transparent plastic member having parallel sides 12*a*, 12*b* sees an image I of the object O at the surface 12*b* of the member 11.

Referring now more particularly to FIG. 2, if the object O is against a surface 13 of a prism of triangular cross section of light refractive material which is transparent, the eye 10 of the observer sees an image $I_1$ at surface 14 and an image $I_2$ at surface 15. The position of the image $I_1$ is determined by drawing a line 16 which bisects the total angle 17*a*, 17*b* and by drawing a line 18 perpendicular to the line 16. The position of the image $I_2$ is determined in a similar manner with reference to total angle 17*c*, 17*d* and lines 19*a* and 19*b*.

Figure 3:
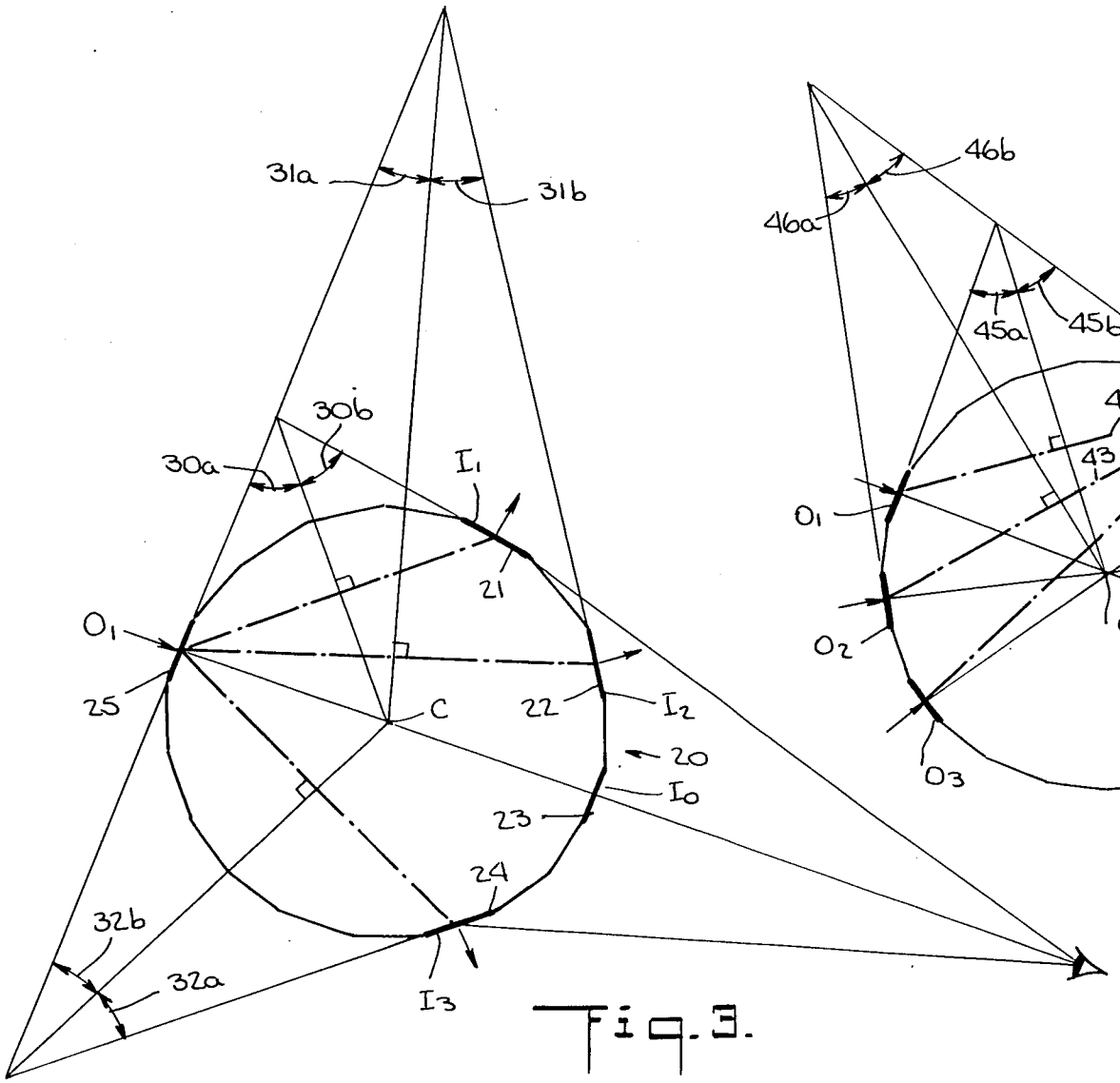

Referring now more particularly to FIG. 3, a light-source multiplication device comprises a light-transmissive portion 20 having faces 21, 22, 23, 24, 25 having apices on an imaginary spherical surface having a center C. The light-transmissive portion preferably is transparent and may, for example, be of the same material as the member 11 of FIG. 1. The light-source multiplication device also includes at least one light source $O_1$ disposed in proximity to at least one of said faces, for example facet 25, for transmitting light through said light transmissive portion 20 to form a visible image $I_1$, $I_2$, $I_3$, $I_0$ at a plurality of faces 21, 22, 24, 23, respectively.

The facet 23 is parallel to the facet 25 and the position of the image $I_0$ is determined as explained in connection with FIG. 1. The faces 21, 22, 24 preferably are facets at which images $I_1$, $I_2$, $I_3$ appear as explained in connection with FIG. 2 having reference to triangles having angle 30*a*, 30*b* and angle 31*a*, 31*b* and angle 32*a*, 32*b*. These images are visible at the designated facets by the eye 10 only at the position represented in FIG. 3. It will be understood that the light-transmissive portion 20 preferably is a multi-prism having facets on an imaginary spherical surface and that the angles 30*a*, 30*b*, 31*a*, 31*b*, 32*a*, 32*b* and the triangles including those angles are diagrammatic lines for explanatory purposes only. The bisectors of the angle 30*a*, 30*b*, the angle 31*a*, 31*b* and the angle 32*a*, 32*b* pass through the center C of the imaginary spherical surface.

Referring now more particularly to FIG. 4, the light-transmissive portion 40 having faces having apices on an imaginary spherical surface having a center C preferably also is a transparent multi-prism. Three light sources $O_1$, $O_2$ and $O_3$ are utilized to indicate how an image $I_1$ is transmitted to a face 41 which preferably is a facet, together with an image $I_2$ and an image $I_3$ at the same facet 41. Diagrammatic lines 42, 43 and 44 indicate the path of light transmission through the light-transmissive portion 40 from objects $O_1$, $O_2$, $O_3$ respectively to the facet 41. Diagrammatic triangles similar to those explained in connection with FIGS. 2 and 3 are utilized to indicate how the position of lines 42 and 43 are perpendicular to bisectors of angles 45*a*, 45*b*, and 46*a*, 46*b*. A corresponding triangle (not shown) may be used to indicate the position of line 44. The bisectors of angles 45*a*, 45*b* and 46*a*, 46*b* pass through the center C of the imaginary spherical surface.

The use of three light-emissive diodes $O_1$, $O_2$, $O_3$ positioned at facets as represented in FIG. 4 enables an image to be seen at facet 41 from a plurality of positions of an eye 46 including positions 1, 2 and 3.

Referring now more particularly to FIGS. 5, 6 and 7, a light-source multiplication device comprises a light-transmissive portion 50 having faces, preferably facets, having apices 52 on an imaginary spherical surface. At least one light-source, preferably comprising a light-emissive diode 51, is disposed in proximity to at least one of the faces for transmitting light through the light-transmissive portion 50 to form a visible image at a plurality of faces.

Referring to FIG. 6, the total front face of the light-transmissive portion 50 opposite the light-emissive diode 51 is there represented. A heavy lined hexagonal region 60 of the FIG. 6 total front face is reproduced in FIG. 7 as the region within which images of the light-emissive diode 51 appear at individual facets of the multi-prism as represented by regions 61. These images are visible from a position opposite the light-emissive diode 51 along a straight line passing from the observer's eye through the center of the light-transmissive portion 50 (the center of the imaginary spherical surface) to the light-emissive diode 51.

Figure 8:
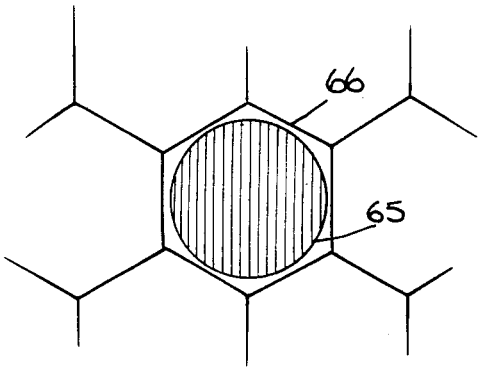
FIGS. 8 and 9 are fragmentary schematic views to an enlarged scale of the FIGS. 5, 6 and 7 device.
Figure 9:
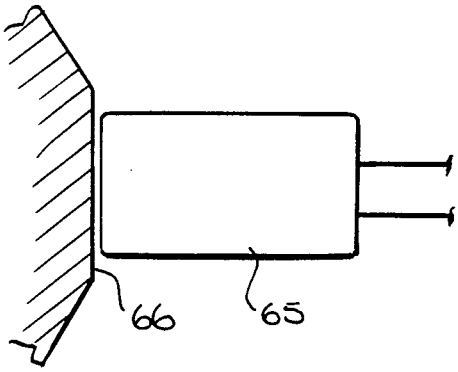

Referring now more particularly to FIGS. 8 and 9, FIG. 8 is an enlarged, fragmentary view representing a preferred hexagonal shape for the individual facets of the light-transmissive portion having their apices on an imaginary spherical surface. A light-emissive diode 65 is positioned adjacent one of the facets 66 in FIGS. 8 and 9, which represent fragmentary rear and fragmentary elevational views of a preferred configuration because the area of the face of the light-emissive diode utilizes substantially the entire area of a single facet.

Figure 10:
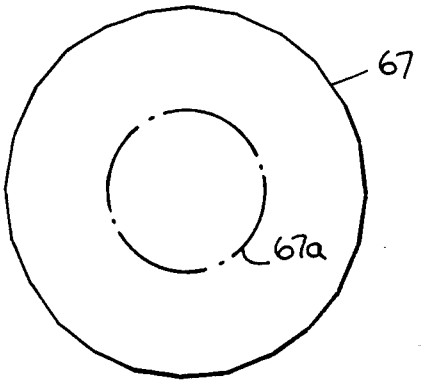
FIG. 10 is a schematic diagram of a light-transmissive body useful in my device.
Figure 11:
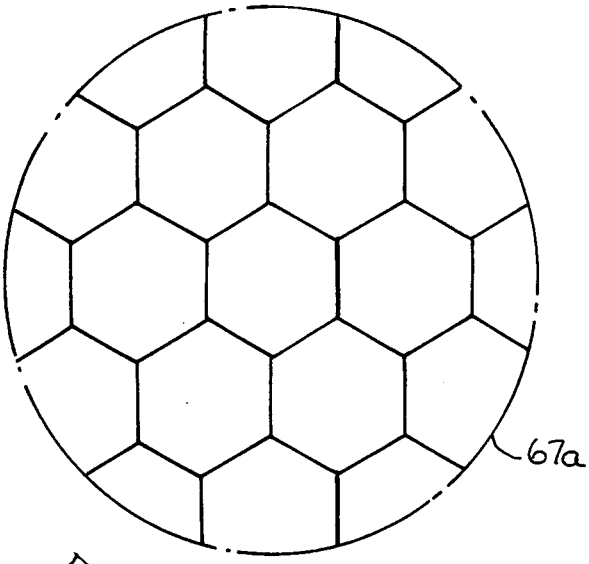
FIG. 11 is a schematic diagram of a portion of the body of FIG. 10 to an enlarged scale.

Referring now to FIGS. 10 and 11, FIG. 10 represents a rear view of a preferred light-transmissive portion 67 having facets having apices on an imaginary spherical surface. FIG. 11 represents in an enlarged fragmentary view the facets within the circle 67*a l of FIG. 10.*

Figure 12:
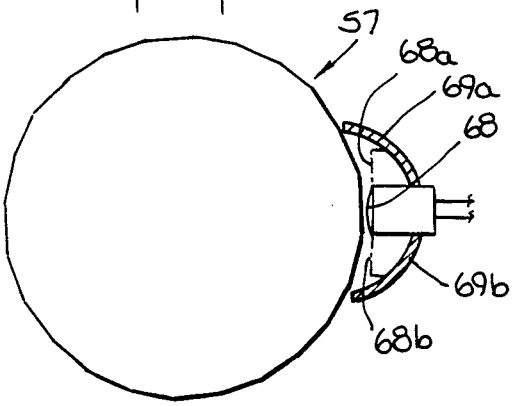
FIG. 12 is a schematic diagram of an embodiment of my invention.
Figure 13:
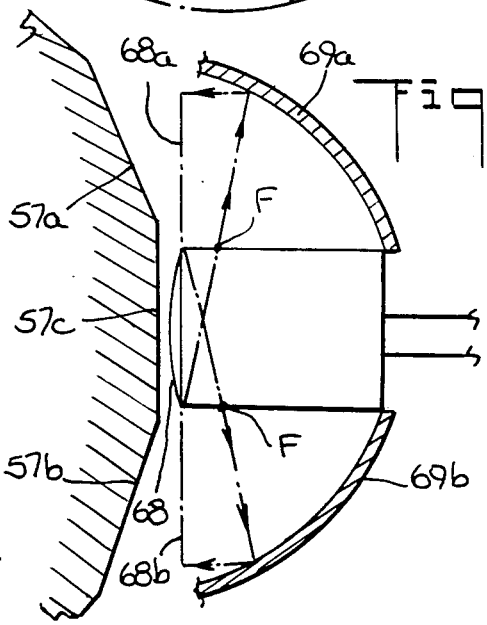
FIG. 13 is a fragmentary view, to an enlarged scale, of the FIG. 12 embodiment.

Referring now more particularly to FIGS. 12 and 13, a light-transmissive portion 57 having facets having apices on an imaginary spherical surface is represented together with a light-emissive diode 68 and at least one mirror portion 69*a* for reflecting an image of the light-emissive diode 68 to a face adjacent the face to which the light-emissive diode 68 is in proximity. Thus, due to the concavity of the mirror 69*a*, which may, for example, be a metal or other highly reflective mirror surface, an image 68*a* of the diode 68 is reflected to a face 57*a* adjacent the face 57*c* to which the diode 68 is in proximity. Similarly, an image 68*b* of the light-emissive diode is reflected by a second mirror portion 69*b* to a face 57*b* adjacent the face 57*c*.

Figure 25:
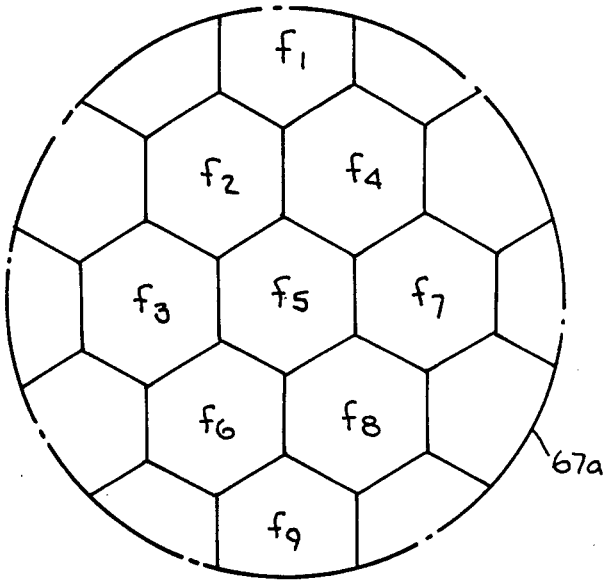
FIGS. 25, 26 and 27 are fragmentary, schematic rear views the light-transmissive portions of three-color embodiments of my device.
Figure 26:
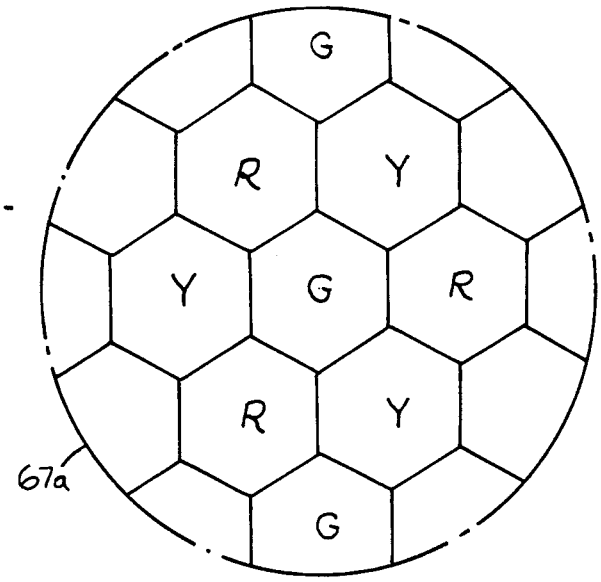

Referring now to FIGS. 25 and 26, FIG. 25 represents the light-transmissive portion 67*a* of FIG. 11 having certain facets thereof $f_1$ to $f_9$, inclusive. Referring to FIG. 26, in lieu of the diodes being all of one color, the diodes may be, for example, of three colors, such as red, green and yellow suitable for a traffic signal light device. All diodes of the same color preferably are electrically connected together. Suitable conventional electrical switching may be utilized to illuminate the red diodes simultaneously to present a red light, and to switch to yellow and to green as desired. No mirrors are utilized in the device represented by FIG. 26. The colors of the diodes adjacent the facets $f_1$–$f_9$ are represented by the letters R for red, Y for yellow and G for green.

Figure 27:
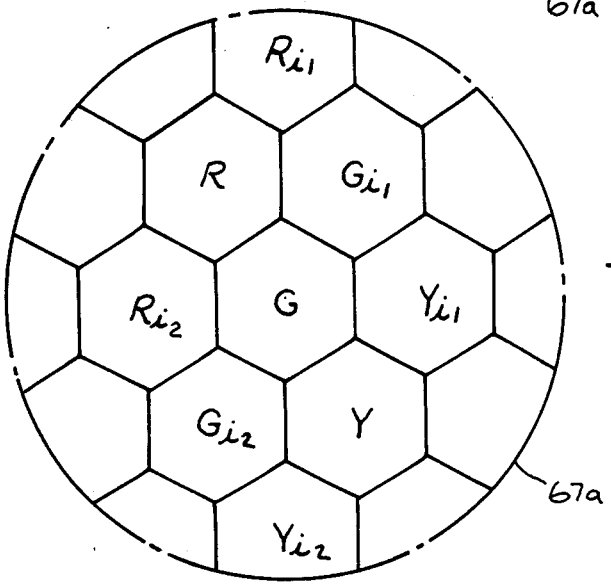

Referring now to FIGS. 25 and 27, a green light emissive diode G is placed adjacent the facet $f_5$ designated G and by utilizing the mirrors such as represented in FIGS. 12 and 13 a real image $G_{i1}$ is reflected to the facet $f_4$ to provide a second green effective light source and an image $G_{i2}$ is reflected to the facet $f_6$ to provide a third effective green light source. The red and yellow light sources R and Y, respectively, adjacent facets $f_2$ and $f_8$, respectively, also have adjacent mirror portions which reflect effective second and third red and yellow real images $R_{i1}$, $R_{i2}$ and $Y_{i1}$, $Y_{i2}$, respectively, as effective light sources to the facets $f_1$, $f_3$ and $f_7$, $f_9$, respectively. This pattern of light sources and mirrors may be repeated at additional facets in a similar manner to provide a desired field of vision.

Figure 14:
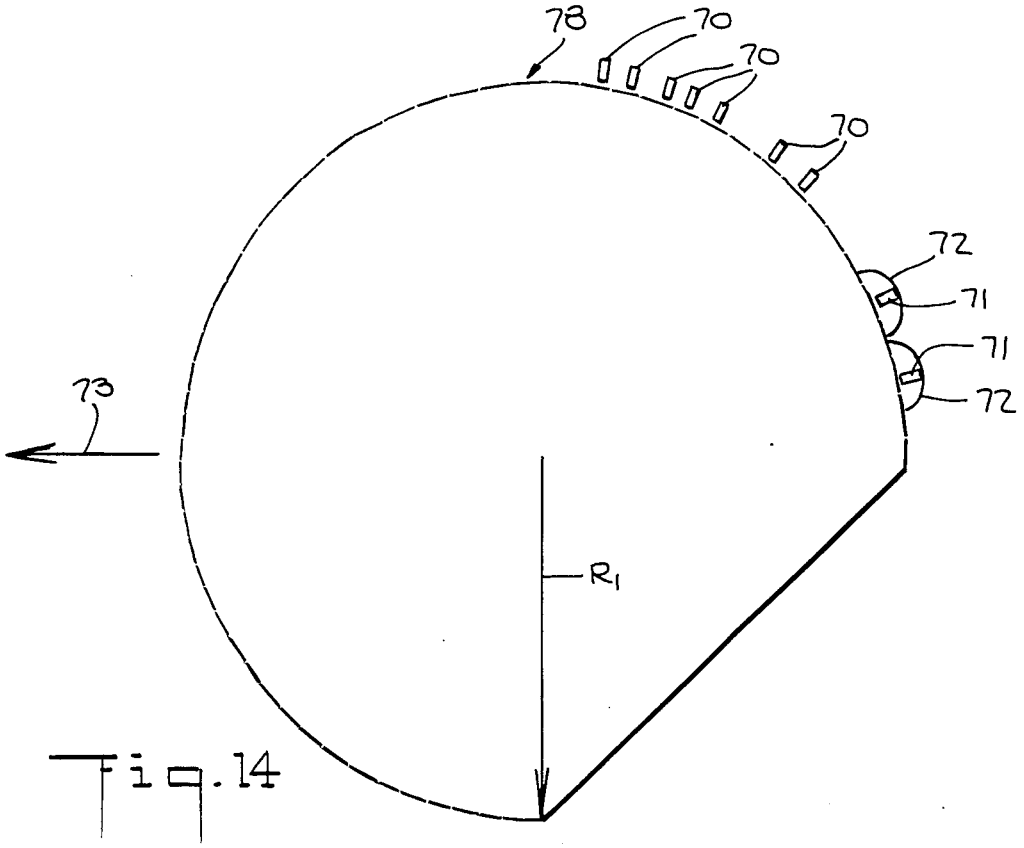
FIG. 14 is a schematic diagram of a side view of a portion of a light transmissive body with light-emissive diodes, represented diagrammatically, in accordance with my invention.

Referring now to FIG. 14, there is represented a light-source multiplication device having a light-transmissive portion 78 in accordance with the invention which may be suitable for use in a traffic signal device. Light-emissive diodes 70 are positioned at individual facets of the light-transmissive portion and light-transmissive diodes 71 are positioned with concave mirror portions 72 at individual facets of the light-transmissive portion 78. It will be understood that the diodes and mirror portions are represented diagrammatically and that additional diodes or additional diodes and mirror portions may be utilized to cover a surface area extending around a portion of the light-transmissive portion 78 outlined, for example, within a circle thereon. One of the directions of visibility of the light-emissive diodes from the face of the light transmissive portion 78 is represented by the arrow 73. The light-transmissive portion 78 may have a radius $R_1$ in the range of, for example, 3½ to 6 inches for use in a traffic signal light device or warning light device. The portion of the light-transmissive portion 78 which is planar omits a portion of an approximately spherical surface, but this is without deleterious effect in the application for the light-transmissive portion 78 since no light would be transmitted to an observer through the omitted portion.

Figure 15:
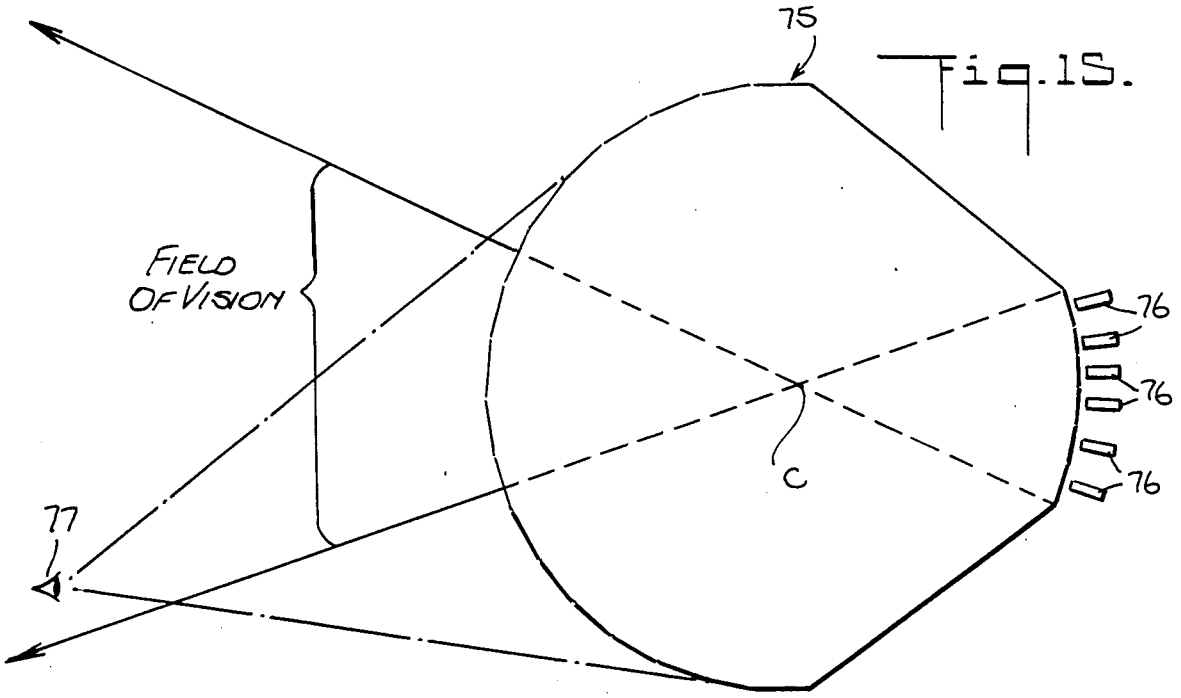
FIG. 15 is a schematic diagram of a side elevational view of another embodiment of my invention.

Referring now more particularly to FIG. 15, a light-transmissive portion 75 having a plurality of facets is represented schematically with a plurality of light-emissive diodes 76. The field of vision F is represented in one dimension by lines passing from the extreme diodes 76 through the center C of the imaginary sphere on which the apices of the facets are positioned. Thus, the eye 77 positioned anywhere within the field of vision will see multiple images of a diode 76 as previously explained in connection with FIGS. 3 and 4. By positioning diodes 76 also in a direction transverse to the plane of the paper, a field of vision will exist also in the transverse direction, that is, for example, perpendicular to the plane of the paper. Some of the visible images can be seen over wide and different viewing angles in, for example, a vertical plane, and a horizontal plane.

Figure 16:
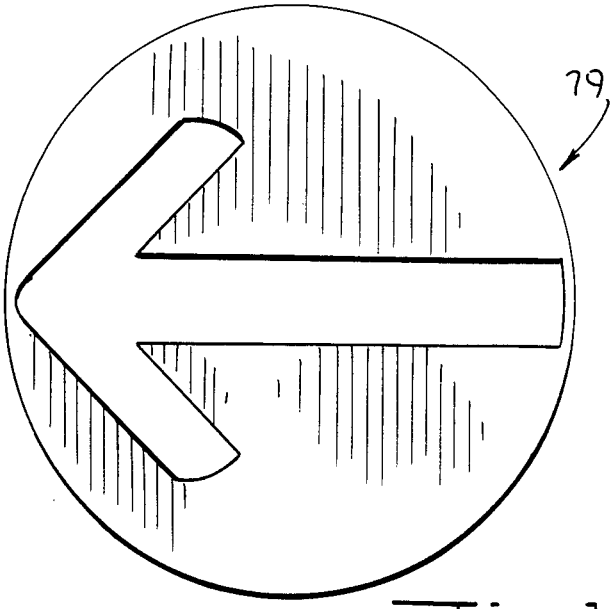
FIG. 16 is a front view of a traffic signal light device in accordance with my invention.

Referring now more particularly to FIG. 16, there is represented a light display 79 or a lighted sign 79 or a traffic signal light device 79 including a light multiplication device as previously described. The face of the sign 79 shows light in the form of an arrow. It will be understood that the lighted sign might also have a face which is not connected with a traffic signal light but may be, for example, a company name or an advertisement for a product.

Figure 17:
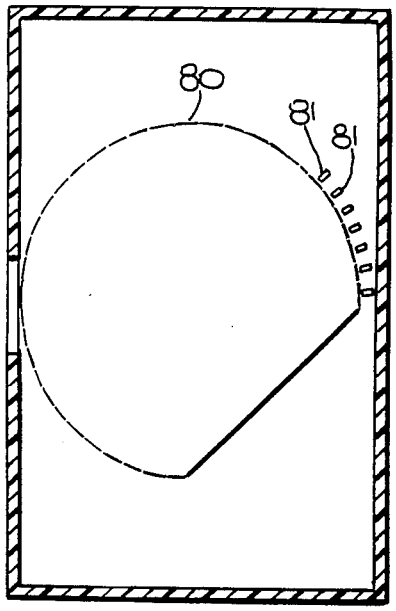
FIG. 17 is a schematic view, in section, representing diagrammatically a device similar to the FIG. 14 device utilized to provide the FIG. 16 display.

Referring to FIG. 17, it will be apparent that the lighted sign 79 of FIG. 16 is in the form of an opaque hollow box having an arrow-shaped opening and a light source multiplication device similar to the device of FIG. 14 therein and having a light-transmissive portion 80 and light-emissive diodes 81 with or without associated concave mirrors.

Figure 18:
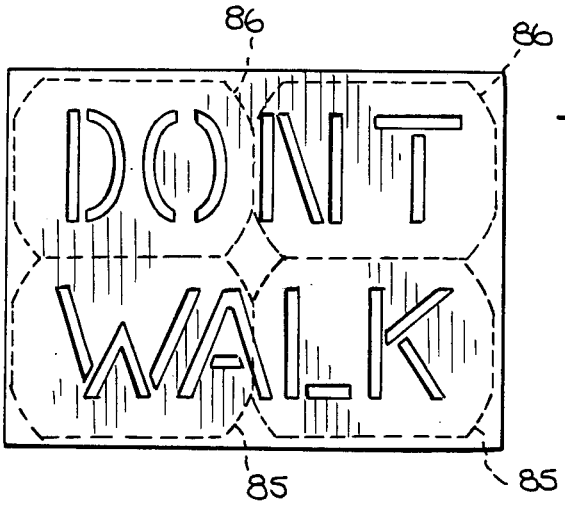
FIG. 18 is a front view of a warning signal device constructed in accordance with my invention.
Figure 19:
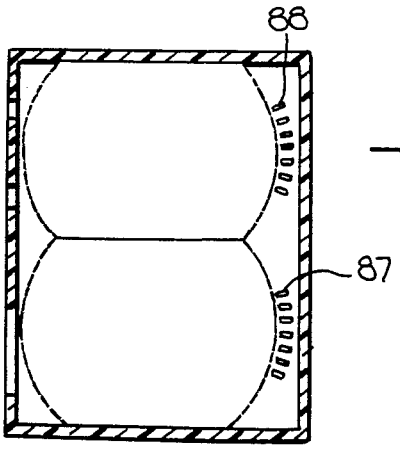
FIG. 19 is a schematic view, in section, of the FIG. 18 device.

Referring now more particularly to FIG. 18, there is represented a warning signal light device including a light-source multiplication device in accordance with the invention. As is apparent the light-source multiplication device has molded light-transmissive portions 85 and 86, as represented in broken-line construction. These portions have facets having apices on an imaginary spherical surface and have light-sources, preferably light-emissive diodes 87, 88 represented in FIG. 19 disposed in proximity to the facets for transmitting light through the light-transmissive portion to form a visible image at a plurality of the facets. The diodes 87 may be of, for example, two colors such as red and green while the diodes 88 may be, for example, of a red color. Accordingly, with suitable conventional electrical switching a green "WALK" sign may be illuminated or a red "DON'T WALK" sign may be illuminated.

Figure 20:
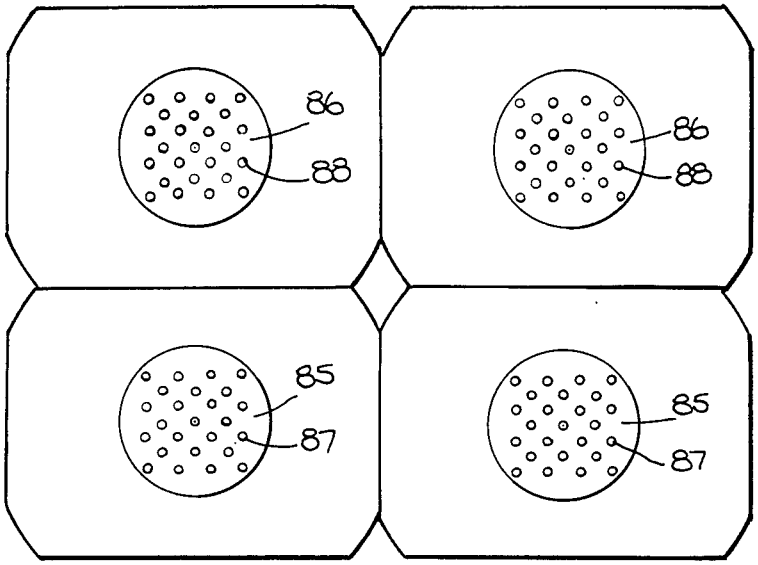
FIG. 20 is a schematic rear view of a portion of the FIG. 19 device.
Figure 21:
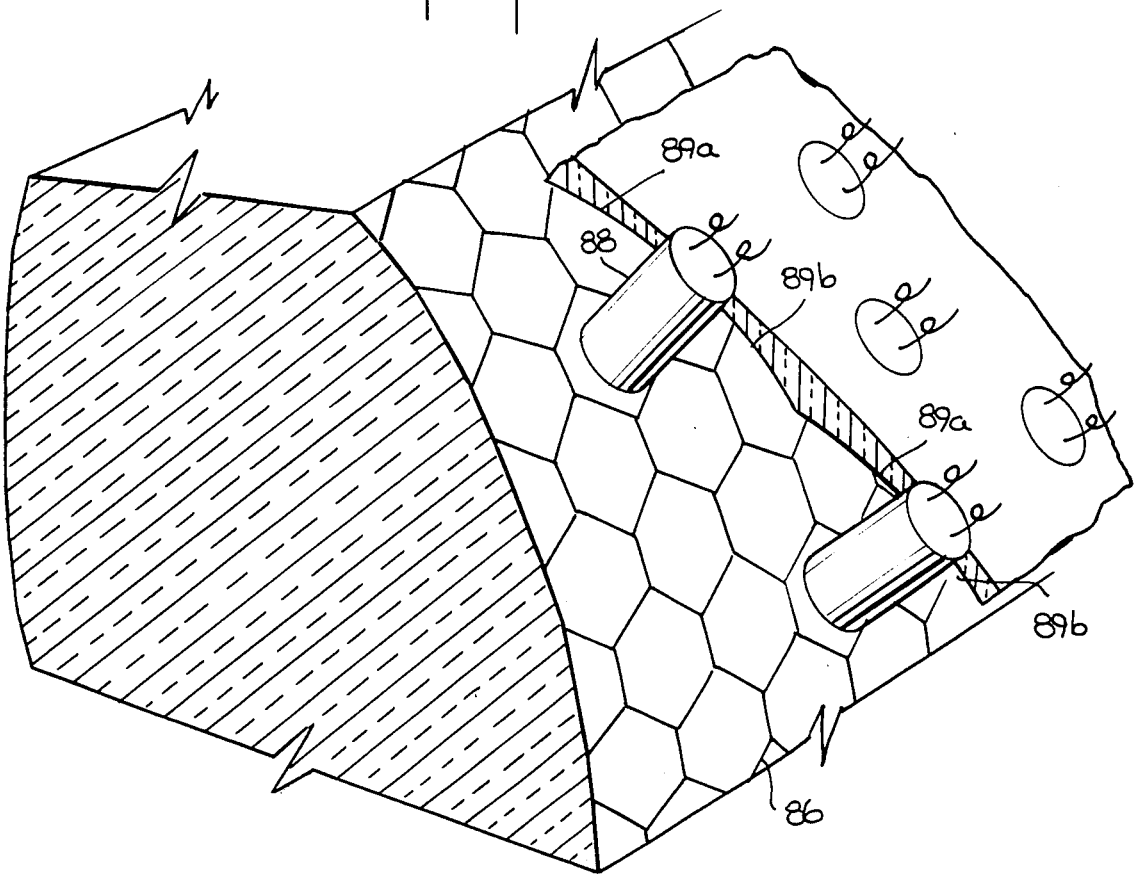
FIG. 21 is an enlarged, fragmentary, perspective view of the FIG. 20 device shown diagrammatically.

Referring now more particularly to FIGS. 20 and 21, a rear view of the light-transmissive portions 85, 86 of FIG. 18 is represented in FIG. 20 and a perspective, diagrammatic view, partly broken away, of the light-transmissive portions 86 of FIG. 18 is represented in FIG. 21. The diodes 88 are shown disposed in proximity to the light-transmissive portion 86 and has concave mirror portions 89*a*, 89*b* disposed therewith to reduce the number of light-emissive diodes utilized, as represented in FIG. 21.

The FIG. 20 device includes a plurality of light sources 88 disposed in proximity to a plurality of faces of each light-transmissive portion 86 to form visible images at a plurality of faces at the front of the light-transmissive portion 86 which is a larger number than the plurality of light sources 88.

Figure 22:
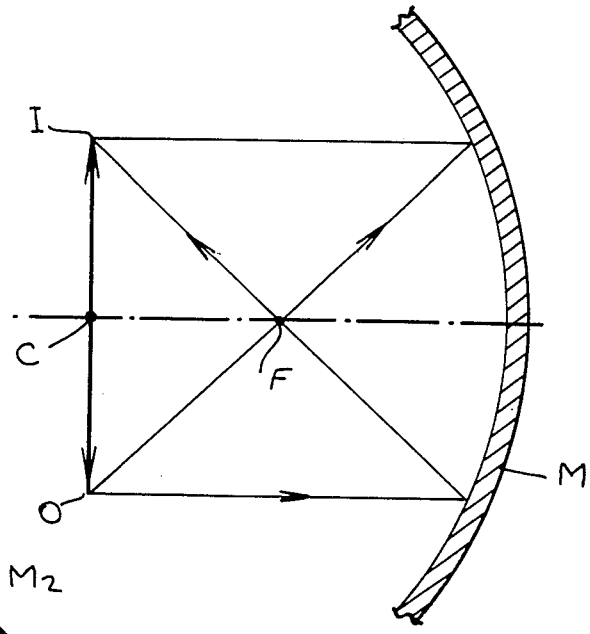
FIGS. 22, 23 and 24 are schematic diagrams to aid in explaining the operation of the FIG. 21 embodiment.
Figure 23:
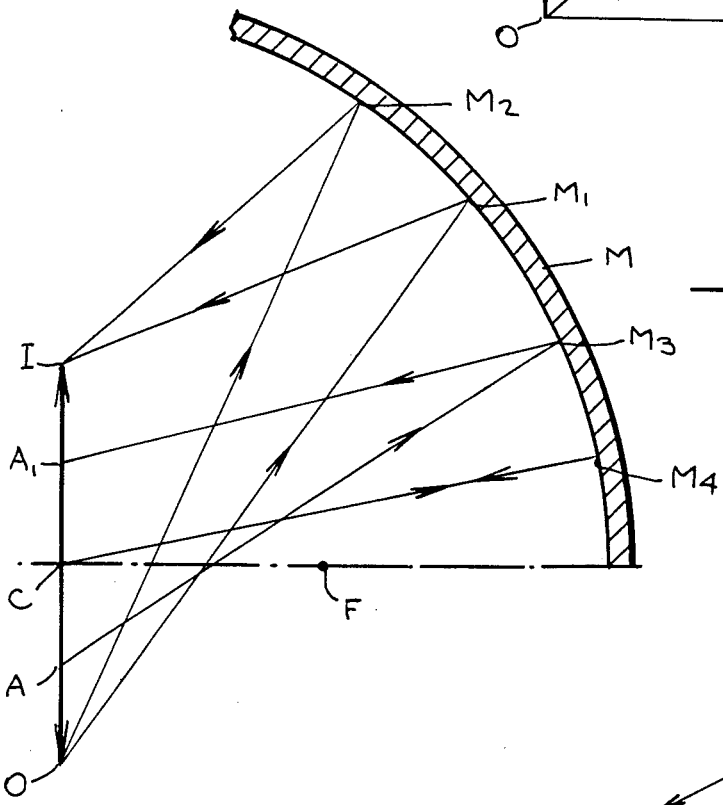
Figure 24:
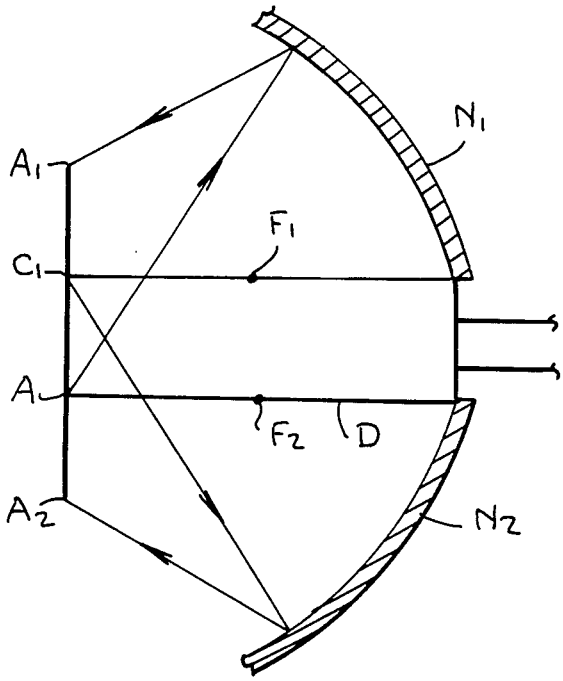

Referring now more particularly to FIGS. 22, 23 and 24 to aid in explaining the operation of the FIGS. 20 and 21 embodiment, in FIG. 22 there is represented an object CO extending from the center of curvature of a mirror M. The axis of the mirror passes from the center C through the focal point F. Each ray parallel to the axis from the object CO is reflected through the focus or focal point and each ray from the object CO through the focal point F is reflected parallel to the axis CF.

FIG. 23 represents the paths of other light rays from the object CO to the mirror M and reflected from the mirror to form the image CI. The light ray $OM_1$ is reflected as the ray $M_1I$, the light ray $OM_2$ is reflected as the ray $M_2I$. The ray $AM_3$ is reflected as the ray $M_3A_1$ and the ray CM4 rebounds as the ray $M_4C$ because it comes from the center of the mirror. Thus, to provide the full real image CI it is not necessary to have a full concave mirror but only a portion of a mirror, for example, as represented in FIG. 23.

Referring to FIG. 24, in order to obtain two real images of a diode D, two different mirror portions $N_1$ and $N_2$ are utilized. The two concave mirror portions $N_1$ and $N_2$ have two focal points $F_1$ and $F_2$, respectively, and two centers of curvature $C_1$ and A, respectively. With the object being the face $C_1A$ of diode D, two real images $C_1A_1$ and $AA_2$ are obtained. These images and the face of the diode are adjacent the facets of the light transmissive portion as explained previously in connection with FIGS. 25, 26 and 27.

Figure 28:
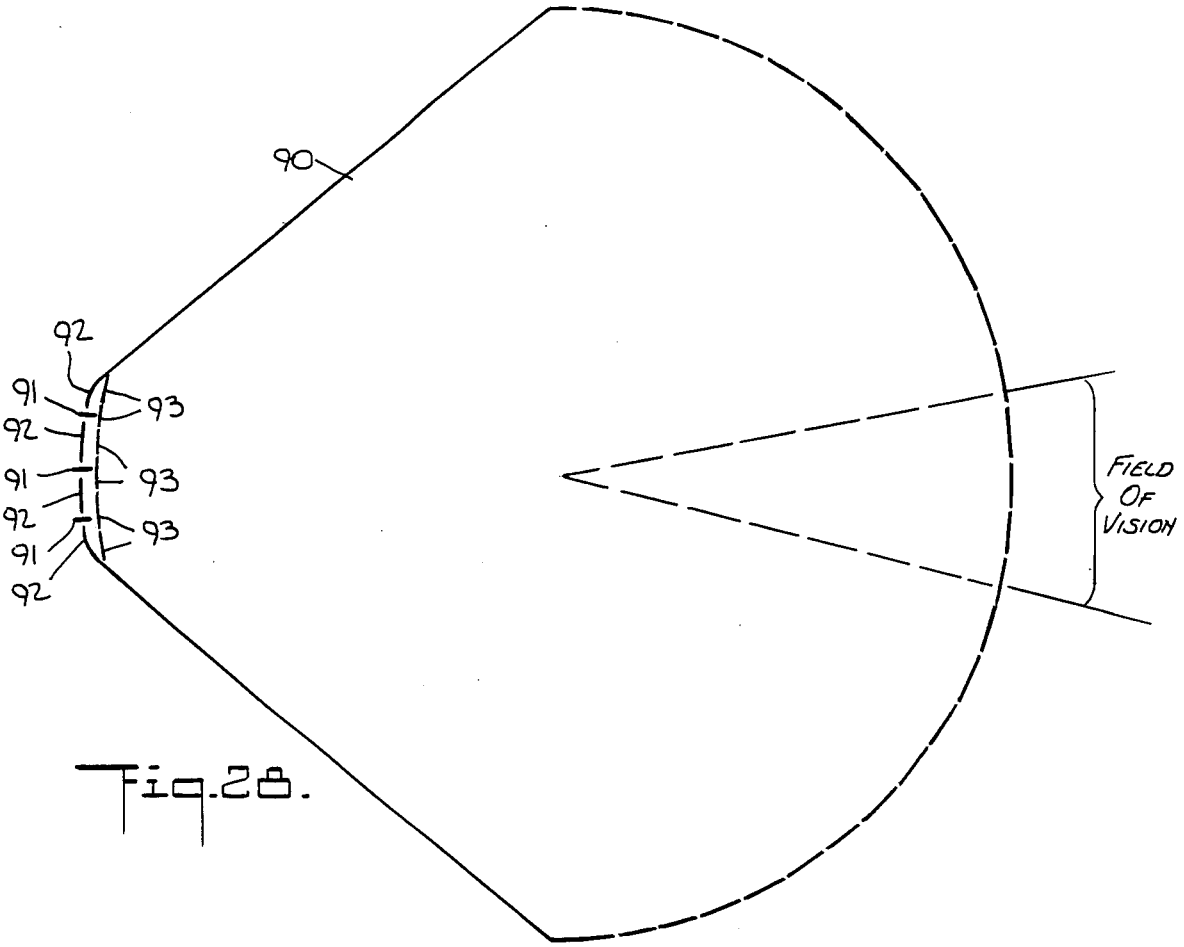
FIG. 28 is a schematic, fragmentary, side elevational view of a warning signal device constructed in accordance with my invention.
Figure 29:
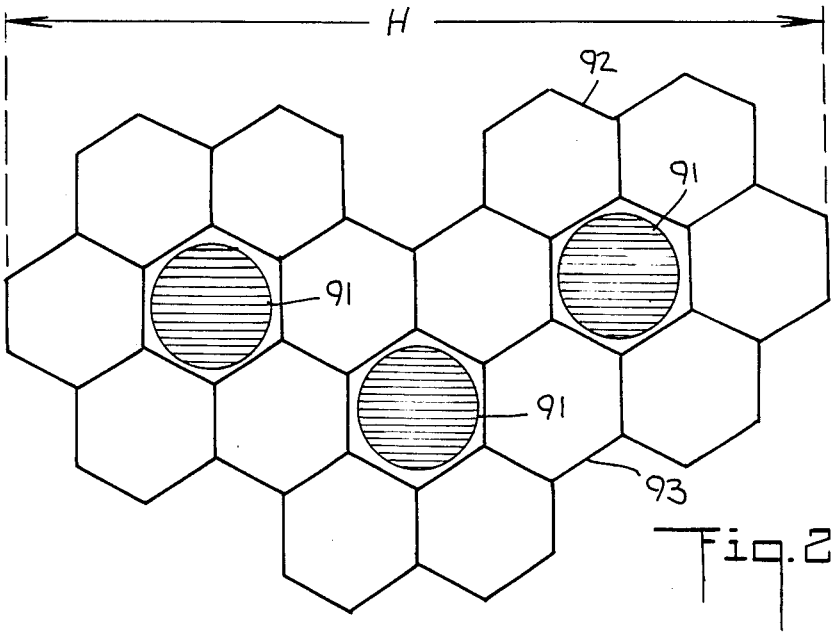
FIG. 29 is a fragmentary, schematic rear view of the light-transmissive portions of the FIG. 28 device to an enlarged scale.

Referring now to FIGS. 28 and 29, there is represented a warning light device, which may, for example, be a yellow construction light of the flashing type or the steady burning type. The warning light device includes a light-source multiplication device comprising a light-transmissive portion 90 which may, for example, have a diameter of six inches. Three yellow diodes 91 are represented at the rear of the light-transmissive portion each in proximity to one of the adjacent faces 93 having a hexagonal shape and having apices on an imaginary spherical surface for transmitting light through the light-transmissive portion 90 to form a visible image at a plurality of the adjacent faces on the front of the light having apices on an imaginary spherical surface.

The light device also includes a plurality of concave mirror portions 92 adjacent at least one light source 91 for reflecting images of the light source 91 to faces adjacent the aforesaid at least one face 93.

The diodes 91 in relation to the faces or facets 93 at the rear of the light-transmissive portion 90 are represented in FIG. 29. Each diode can be seen in a field of vision having, for example, an angle of 3.76°. The values of the minimum effective intensity and the minimum beam candle are maintained, for example, within a minimum solid angle of 9° on each side of the vertical axis and a minimum of 5° above and 5° below the horizontal axis. In the FIG. 28 embodiment the horizontal field of vision has, for example, an angle larger than 18° and the vertical field of vision has, for example, an angle larger than 10°. The warning light device requires, for example, only three diodes having specifications of 20 milliamperes at a voltage of 2.2 volts. In a series circuit therefore, a voltage source of 6.6 volts can be utilized to provide a current of 20 milliamperes. The maximum horizontal dimension H across the faces 92 as viewed in FIG. 29 may, for example, be $1\frac{1}{4}$ inch.

Embodiments of the invention may also be used in light displays other than traffic signal lights or warning lights, for example, embodiments of the invention may be used in advertising light displays.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A light-source multiplication device comprising:

a light-transmissive prism portion having a front and a rear having facets having apices on an imaginary spherical surface; and at least one light source disposed at the rear of said light-transmissive portion outside and adjacent only a single one of said facets for transmitting light through said prism portion to form a visible image at a plurality of predetermined facets at the front of said light-transmissive portion and not visible at other predetermined facets.

2. A device in accordance with claim 1, in which said light source is a light-emissive diode.

3. A device in accordance with claim 1, in which said light-transmissive portion is transparent.

4. A device in accordance with claim 1, in which said plurality of facets includes facets adjacent to each other.

5. A device in accordance with claim 1, which includes at least one mirror portion for reflecting an image of said light source to a facet adjacent said at least one facet.

6. A device in accordance with claim 5, in which said mirror portion is a concave mirror portion.

7. A device in accordance with claim 5, which includes at least two mirror portions and in which said at least two mirror portions reflect images of said light source to at least two facets adjacent said at least one facet.

8. A device in accordance with claim 1, in which a plurality of light sources are disposed in proximity to a plurality of facets to form visible images at a plurality of facets which is a larger number than said plurality of light sources.

9. A device in accordance with claim 8, in which some of said visible images can be seen over a viewing angle larger than 10°.

10. A device in accordance with claim 8, which includes a plurality of light sources of a first color and a plurality of light sources of a second color.

11. A device in accordance with claim 1, in which said at least one light source is disposed at the rear of said light-transmissive portion and said visible image is visible at a plurality of said facets at the front of said light-transmissive portion.

12. A warning light device including a light-source multiplication device in accordance with claim 1.

13. A traffic signal light device including a light-source multiplication device in accordance with claim 1.

14. A lighted sign including a light source multiplication device in accordance with claim 1.

15. A light display including a light-source multiplication device in accordance with claim 1.

16. A device in accordance with claim 1, in which said faces are of hexagonal shape.

17. A device in accordance with claim 1, which includes at least another light source disposed at the rear of said light-transmissive portion outside and adjacent only another single one of said facets for transmitting light through said prism portion.

18. A warning light device including a light source multiplication device comprising:

a light-transmissive prism portion having a front and a rear and having facets having apices on an imaginary spherical surface;

at least one light source disposed at the rear of said light-transmissive portion outside and adjacent only a single one of said facets for transmitting light through said prism portion to form a visible image at a plurality of predetermined facets at the front of said light-transmissive portion and not visible at other predetermined facets; and a plurality of concave mirror portions adjacent said at least one light source for reflecting images of said at least light source to facets adjacent said single one of said facets.

* * * * *